US006616366B1

(12) United States Patent
Weihrauch

(10) Patent No.: US 6,616,366 B1
(45) Date of Patent: Sep. 9, 2003

(54) APPLICATOR BRUSH FOR LIQUID OR PASTY MEANS, ESPECIALLY FOR DECORATIVE COSMETICS SUCH AS MASCARA AND METHOD FOR PRODUCING SAME

(75) Inventor: Georg Weihrauch, Wald-Michelbach (DE)

(73) Assignee: Coronet-Werke GmbH, Wald-Michelbach (DE)

( * ) Notice: Subject to any disclaimer, the term of this patent is extended or adjusted under 35 U.S.C. 154(b) by 0 days.

(21) Appl. No.: 09/914,952

(22) PCT Filed: Mar. 6, 2000

(86) PCT No.: PCT/EP00/01873

§ 371 (c)(1),
(2), (4) Date: Sep. 6, 2001

(87) PCT Pub. No.: WO00/54623

PCT Pub. Date: Sep. 21, 2000

(30) Foreign Application Priority Data

Mar. 16, 1999 (DE) ..... 199 11 763

(51) Int. Cl.[7] ..... A46B 11/04

(52) U.S. Cl. ..... 401/286; 401/129; 15/187; 15/188; 132/216; 132/218; 300/20; 300/21

(58) Field of Search ..... 401/286, 129, 401/126; 15/187, 188, 160, 244.1; 132/216, 218; 300/20, 21

(56) References Cited

U.S. PATENT DOCUMENTS

| | | | | |
|---|---|---|---|---|
| 4,403,624 A | | 9/1983 | Montgomery | |
| 4,422,986 A | * | 12/1983 | Cole | 264/39 |
| 4,565,205 A | * | 1/1986 | Taylor | 132/88.7 |
| 4,635,659 A | | 1/1987 | Spatz | |
| 4,810,122 A | | 3/1989 | Cole | |
| 4,964,429 A | | 10/1990 | Cole | |

FOREIGN PATENT DOCUMENTS

| | | |
|---|---|---|
| DE | 80 10 740 | 8/1980 |
| DE | 36 15 593 | 11/1987 |
| DE | 37 40 320 | 6/1988 |
| DE | 39 33 990 | 4/1990 |
| DE | 196 19 053 | 11/1997 |
| EP | 0 038 524 | 10/1981 |
| EP | 0 204 466 | 10/1986 |
| EP | 0 244 864 | 11/1987 |

* cited by examiner

*Primary Examiner*—David J. Walczak
(74) *Attorney, Agent, or Firm*—Paul Vincent

(57) ABSTRACT

An applicator brush for liquid or pasty media, especially for decorative cosmetics such as mascara. The brush comprises a rod-shaped support (11) which is provided with a plurality of injection-molded projections (12) on the outside thereof. The projections (12) are made of synthetic material, protrude radially in different directions and are arranged at a mutual distance from each other. The aim of the invention is to reliably obtain a good combing effect and equal appliance of the means to be applied. To this end, the projections (12) are provided with a cross-section which tapers towards the free end of the projections (12). The projections (12) and the support (11) are made from a flexible synthetic material, especially an elastomeric synthetic material.

8 Claims, 5 Drawing Sheets

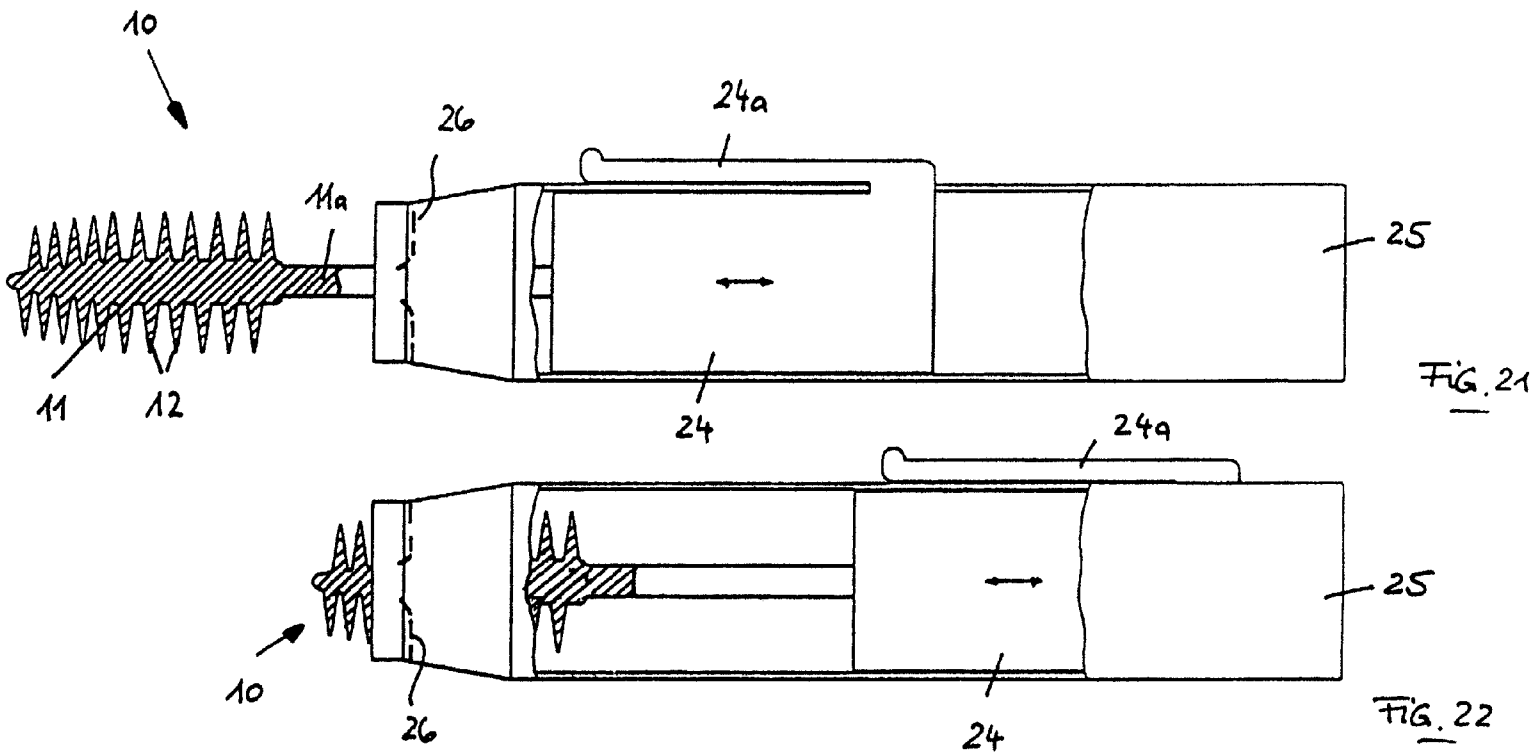
FIG. 21
FIG. 22
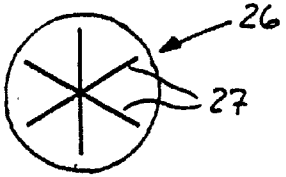
FIG. 23

APPLICATOR BRUSH FOR LIQUID OR PASTY MEANS, ESPECIALLY FOR DECORATIVE COSMETICS SUCH AS MASCARA AND METHOD FOR PRODUCING SAME

BACKGROUND OF THE INVENTION

The invention concerns an applicator brush for liquid or pasty media, in particular for decorative cosmetics such as mascara, with a rod-shaped support the outer side of which has a plurality of injected fingers of plastic material which are disposed at mutual separations to project radially in different directions. The invention also concerns a method for producing a corresponding applicator brush.

Applicator brushes of this type can be used for different purposes. The application of so-called mascara is described below. The inventive applicator brush can also be used for coloring strands of hair, and for applying pharmaceuticals or cleaning agents.

An applicator brush for mascara should simultaneously satisfy different requirements to permit advantageous application of the mascara. The applicator brush should at least comb the eyelashes and optionally the eyebrows before applying the mascara, thereby aligning them in the desired fashion. The applicator brush should accept a sufficient amount of mascara to permit coloring of all eyelashes or hair therewith, while avoiding frequent dipping of same into the mascara supply container. Since the mascara should be applied uniformly and without spilling, there can be no excess mascara on the applicator brush. Towards this end, the applicator brush is usually wiped off when pulled out of the supply container.

Since the applicator brush is formed as a freely projecting component having a handle at one end, it must be sufficiently stable to absorb the forces exerted during use to prevent it from breaking. On the other hand, the applicator brush must be flexible enough to adjust to the curvatures of the eyelids and eyebrows and must yield sufficiently during improper use to prevent injuries to the eye region.

To prevent user allergic reactions, the applicator brush should contain no metal and mold fungus and bacteria contamination should be largely prevented. This can be achieved e.g. in that unused residual mascara does not cling to the applicator brush, since these residual amounts are a good basis for mold fungus and bacteria growth.

The applicator brush can be used for applying mascara onto the eyelashes and also for applying mascara onto the eyelids as so-called eyeliner.

When the supply container is empty, the applicator brush is usually disposed of therewith. Since the applicator brush is relatively expensive to manufacture compared to the mascara, it should be produced as inexpensively as possible.

The known applicator brushes satisfy only some of the abovementioned requirements and have further disadvantages.

It is known to dispose a plurality of short bristles between several wires and twist them such that the bristles are held between the wires. Such a twisted applicator brush, which is mostly used today as a mascara applicator, is described e.g. in U.S. Pat. No. 4,982,838. A substantial disadvantage of a twisted applicator brush is that a large portion of the mascara is retained in the regions formed between the bristles during use, due to the compact arrangement of the bristles, in which dirt, e.g. spores or bacteria can develop. Moreover, such an applicator brush does not provide uniform combing of the eyelashes or hair due to the plurality of densely packed bristles, since the bristles cannot engage with the eyelashes or hair in a combing fashion.

To improve the combing action, DE 80 26 372 U1 has attempted to incorporate an asymmetric bristle support into the twisted wires. A construction of this type is very demanding and does not actually improve the combing effect since the plurality of bristles form a surface which blocks the eyelashes or hair such that the hair cannot penetrate between the bristles to an extent which would be required to obtain a good combing effect.

The production of twisted applicator brushes is also relatively expensive since the wires and bristles are produced individually and the bristles must be subsequently twisted into the wires, which is complicated from an apparatus point of view. The bristle ends must also be thereby deburred and ground to prevent the ends from having sharp edges which could cause injuries. A further additional disadvantage of twisted applicator brushes is that the metal core formed from the twisted metal wires can bend during use which makes the applicator brush useless and presents a great danger to the eye region of the user.

To eliminate the disadvantages of twisted applicator brushes comprising a bristle stock, an applicator brush was developed which comprises injected fingers (described in DE 80 10 740 U1) on which the pre-characterizing part of claim 1 is based. An applicator brush of this type has a relatively rigid tubular support with injected plastic coating having radially outwardly projecting fingers formed in one piece therewith, the fingers having a constant cross-section throughout their length. Attempts were made to improve the combing effect of this applicator brush by giving the individual fingers sufficiently large mutual separations. However, this caused the amount of mascara accepted in the spaces between the fingers to be insufficient. If the fingers are disposed at smaller mutual separations, a sufficient amount of mascara can be received, however, the combing effect is inadequate, since the eyelashes and hair cannot or can only insufficiently penetrate between the fingers. DE 80 10 740 U1 tries to increase the reception capacity for mascara by profiling the fingers. This slightly reduces the above-mentioned problems but does not eliminate them completely.

The desired sequence of combing effect and subsequent application of mascara and optionally renewed final combing is not guaranteed by the applicator brush of DE 80 10 740 U1. Moreover, it does not bend under the application of small forces due to the relatively stiff, central support such that optimum adjustment to the curvature of the eyelids or eyelashes is not ensured.

It is the underlying purpose of the invention to produce an applicator brush of the above-mentioned type which reliably achieves a good combing effect and good, uniform application of the medium to be applied.

SUMMARY OF THE INVENTION

This object is achieved by an applicator brush of the above-mentioned construction in that the fingers have a cross-section which tapers towards their free end and are made, together with the carrier, from an elastic plastic material, in particular an elastomeric plastic material.

The outwardly tapering shape of the fingers ensures that the foot sections of the fingers, where they are connected to the support, have smaller mutual separations than the free ends thereof. The larger separation at the free ends of the fingers ensures that they can easily engage the hair and eyelashes in a combing fashion. Due to the relatively large mutual separation, none or only a small amount of mascara is received in the region of the finger tips which can be almost completely removed by a conventionally provided wiper such that the tip region of the fingers substantially contains no mascara and exercises a pure combing effect. Consequently, the eyelashes and hair are combed before contacting the mascara which is accommodated in the foot region of the fingers. It has turned out that in this fashion, the eyelashes can be excellently pre-positioned before applying the actual mascara.

Due to the relatively small separation between neighboring fingers in their foot region, a sufficiently large amount of mascara can be received to generally avoid frequent dipping of the applicator brush into the supply container.

The inventive applicator brush is also advantageous in that the eyelashes and hair are combed again after application of mascara by moving the finger tips of the applicator brush through the eyelashes with decreasing pressure.

The support and the fingers are formed in one piece from a soft-elastic plastic material to ensure that the applicator brush adjusts to the curvatures of the eyelids even at low pressures thereby reliably preventing breaking of the applicator brush. The applicator brush deforms under excessive pressure but returns into its original shape after pressure-relief.

As mentioned above, the carrier and the fingers are formed in one piece from plastic material. To adjust the stability of the support to the desired purpose of application, the support can be provided with local reinforcing inserts. The shape, arrangement and size of the reinforcing inserts permits exact and simple adjustment of the flexibility of the applicator brush to the desired application.

Advantageously, the reinforcing insert is rod-shaped and extends in the longitudinal direction of the support. It can project from the support such that the projecting part of the reinforcing insert forms a retaining or mounting section at which the applicator brush can be grasped directly or mounted to another holding part.

In a preferred embodiment of the invention, the reinforcing insert consists of plastic material, in particular fiber-reinforced plastic material, e.g. fiber-glass reinforced polypropylene, and the support including fingers is injected onto the reinforcing insert. The reinforcing insert preferably extends over more than half the length of the support and, in particular, over approximately 80% of its length, wherein the material of the support covers the reinforcing insert with sufficient strength to provide the applicator brush in total with sufficient elasticity and flexibility. Preferably, the diameter of the support is three to five times larger than the diameter of the reinforcing insert such that the coating of the reinforcing insert with the elastic plastic material of the support has a thickness of one or two times the diameter of the reinforcing insert.

In a preferred embodiment of the invention, the fingers taper substantially throughout their entire length, from their foot region to the tip region. It is also possible to provide sections of the fingers, e.g. the foot region, with a constant cross-section.

The fingers can have a plurality of different cross-sectional shapes, such as a circular or polygonal cross-section, i.e. a conical or pyramid shape. The fingers may also have a crossed, C- or Y-shaped or annular cross-section. The cross-sectional shape can be selected to provide as large as possible acceptance or continuous delivery of the medium to be applied. The entire applicator brush can comprise fingers of uniform cross-sectional shape. Alternatively, the support comprises fingers having different cross-sectional shapes.

In contrast to the above mentioned twisted bristles, the injected fingers can assume exactly defined positions with respect to one another. This permits precise adjustment of the amount of mascara received and delivered and permits removal of most excess mascara using wipers. In a preferred development of the invention, the fingers are mutually oriented in several planes, separated from one another in the axial direction of the support, wherein selection of the separation between the planes permits adjustment of the application properties of the applicator brush to the medium to be applied. The fingers disposed in one plane are preferably evenly distributed across the circumference of the support, with three to six fingers being disposed in one plane. The fingers in the subsequent planes can be arranged in the same fashion or can be displaced in the circumferential direction of the support.

A first embodiment provides that the fingers are aligned in rows extending in the longitudinal direction of the support, in particular, if there are several evenly spaced planes of fingers. Alternatively, the fingers can be disposed in at least one row extending helically about the support. Sections without fingers may also be provided in the longitudinal direction of the support and in the peripheral direction.

The diameter of human eyelashes is approximately 0.05 to 0.08 mm and of the eyebrow hairs, approximately 0.03 mm to 0.10 mm. In a preferred embodiment of the invention, the separation between neighboring fingers in their foot region is between 0.03 mm and 0.1 mm and, in particular, approximately 0.05 mm. This ensures that a single hair can be accommodated between the foot regions of the fingers and minimizes the chance that several hairs thread between two fingers. Optionally, a separate region can be provided for treating the eyelashes and eyebrows, wherein the separation between the fingers is optimally adapted to the respective hair in that the fingers are disposed on the support in at least two regions having different mutual separations.

In a preferred embodiment of the invention, the fingers can have differing radial lengths. This ensures that the longer fingers comb and align the eyelashes and hair before mascara is applied by the shorter fingers. This is the case in particular, if short and long fingers are alternately disposed in the axial direction of the support.

The application properties of the applicator brush can also be influenced when the surface of the fingers is not smooth but structured. The surface can be e.g. wavy, curled or toothed. In particular, the fingers can have surface depressions for receiving the medium to be applied. The depressions are formed e.g. as small blind holes for storing mascara from which it is gradually and uniformly delivered.

In a further development of the invention, the free ends of the fingers are split several times such that the finger tips are preferably formed like a brush. This ensures that the applicator brush can also reach and comb very fine hair.

The fingers and the support can be made from the same plastic material. Alternatively, fingers of different plastic materials can be disposed on the support thereby providing different combing and application effects, which are recognizable to the user.

The front free end of the support is usually rounded to prevent any risk of injuries. In accordance with the invention, this region can be used for application if the front free end of the support comprises several axially extending fingers. This permits drawing of relatively thin mascara lines using the applicator brush, which permits additional use of the applicator brush as an eyeliner.

The mascara is usually received in the foot region of the fingers by dipping the applicator brush into a mascara supply container. Alternatively, the mascara can also be guided to and exit from the fingers via internal channels. This can be effected e.g. in that the support has one or more internal axial channels into which the medium to be applied can be supplied, wherein the fingers and/or intermediate sections are provided with outlet channels which connect the axial channels to the outside of the applicator brush. The outlet channels either open into the foot region between two neighboring fingers or can extend through the fingers to the finger tip region. A user can support transport of the mascara in the axial channels and in the outlet channels by compressing a section of the axial channel in a region of the support provided therefor to achieve a pumping effect.

In a further embodiment of the invention, the support has an inner axial channel in which a holding means, in particular a holding bar, of at least one additional applicator is guided in an axially displaceable fashion such that the additional applicator can be extended at the front end of the applicator brush and be retracted into the axial channel. The additional applicator can thereby be used as an eyeliner or can be adapted in any other manner to a further application function.

In a further development of the invention, two coaxial holding means are provided in the inner axial channel each of whose front ends carries one additional applicator. The coaxial holding means can be displaced relative to one another and relative to the support to permit optionally extending one or both additional applicators or retraction thereof into the support.

When the applicator brush is not used it must be accommodated in a casing which substantially tightly surrounds it. Conventional applicator brushes are inserted into a casing. A further development of the invention provides that the support comprises a guiding part at its rear end which is slidably received in a casing. Displacement of the guiding part within the casing permits adjustment of the support and fingers between a usage position projecting from the casing and a resting position withdrawn into the casing. Such an extendable applicator brush is advantageous in that the user does not need to separate the applicator brush from the supply container and keep same in her/his hand during use of the applicator brush. Moreover, the inventive design permits use of the applicator brush with one hand, wherein the applicator brush can thereby be easily brought into its position of use.

The casing and the inserted applicator brush are preferably separated from the surroundings via a wiper diaphragm disposed on the casing through which the support penetrates when removing the applicator brush, the wiper diaphragm having a passage shaped in correspondence with the arrangement of the fingers on the support. When extending the support or the fingers, the diaphragm wipes off excess mascara and retains it in the casing. The diaphragm is preferably merely cut or tightly slit to guarantee sufficient sealing of the casing interior in the undeformed state while allowing extension and withdrawal of the support and fingers.

The inventive applicator can be produced in one single step using single or multiple component injection method to facilitate inexpensive production. The reinforcing insert, which consists of a first plastic material, is thereby injected with a second elastic plastic material for forming the support and the fingers which are connected in one piece therewith. The reinforcing insert can either be prefabricated and subsequently be introduced into the injection mold or can be produced or injected directly in the injection mold in a previous step.

Further details and features of the invention can be extracted from the following description of embodiments with reference to the enclosed drawing.

BRIEF DESCRIPTION OF THE DRAWING

FIG. 21 shows an applicator brush including casing in the extended position;

FIG. 22 shows the applicator brush in accordance with FIG. 21 in a partially withdrawn position;

FIG. 23 shows the closing diaphragm of the casing; and

DESCRIPTION OF THE PREFERRED EMBODIMENT

Figure 1:
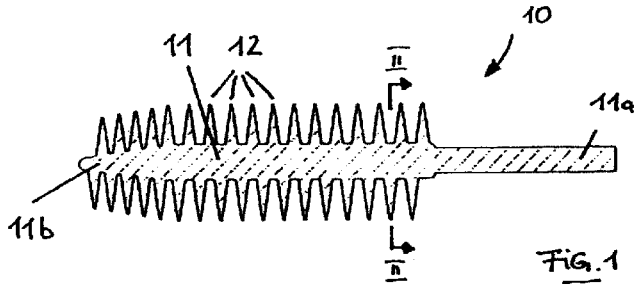
FIG. 1 shows a longitudinal section of a first embodiment of an applicator brush.
Figure 2:
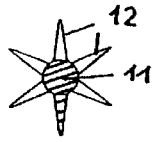
FIG. 2 shows the section II—II of FIG. 1.
Figure 3:
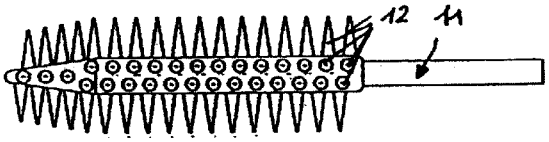
FIG. 3 shows an outer view of the applicator brush in accordance with FIG. 1.

The applicator brush 10 for mascara, shown in FIGS. 1 through 3, includes a rod-shaped support 11 comprising a plurality of fingers 12 on its outside which extend outwardly in different radial directions. The support 11 and the fingers 12 are formed as a single plastic part from a soft-elastic plastic material, in particular, an elastomer. The rear end section 11*a* of the support has no fingers and serves for mounting the support on a handle or actuating part. The support tapers at its front end 11*b* in a conventional fashion and is rounded at its tip.

The fingers 12 are separated from one another and have a cross-section which tapers towards their free end. In the present case, the fingers 12 taper continuously from the foot, i.e. the connecting point to the support 11, towards the tip.

As shown in particular in FIG. 3, the fingers 12 are arranged in a row about the support, wherein, in the embodiment shown (FIG. 2), adjacent fingers 12 are displaced with respect to one another through a peripheral angle of approximately 60° such that the applicator brush 10 has a star-shaped cross-section with six fingers 12 evenly distributed about the circumference.

Figure 4:
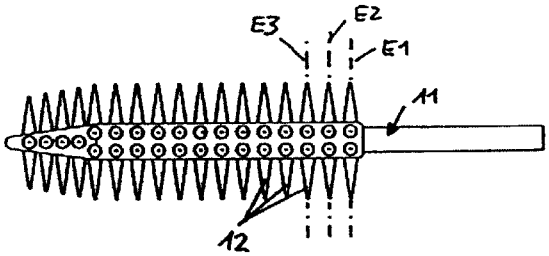
FIG. 4 shows an alternative embodiment of the applicator brush in accordance with FIG. 3.

The embodiment shown in FIG. 4 differs from the above-mentioned embodiment in that the fingers 12 are disposed in several planes E1, E2, E3 . . . , separated in the axial direction of the support 11, wherein the arrangement of the fingers 12 in the individual planes E1, E2, E3 . . . is similar such that the fingers are aligned in several rows extending in the longitudinal direction of the support 11. A plurality of fingers are provided in each plane and may be evenly distributed about the circumference of the support.

Figure 5:
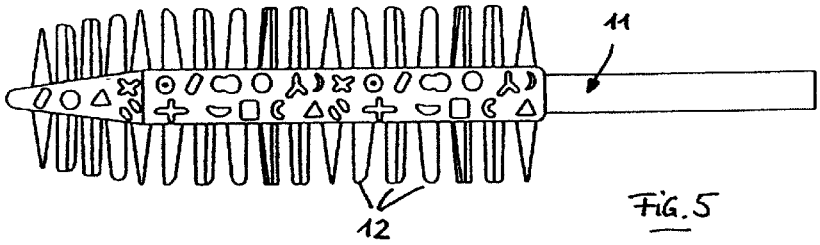
FIG. 5 shows an outer view of a further embodiment of the applicator brush.

While all the fingers of the embodiments described up to now have a conical or pyramid shape, FIG. 5 shows an applicator brush with fingers 12 of different cross-sections disposed on the support 11. FIG. 5 shows that the cross-sections can be circular, triangular, crossed, annular, C-shaped, Y-shaped, square or rectangular.

Figure 6:
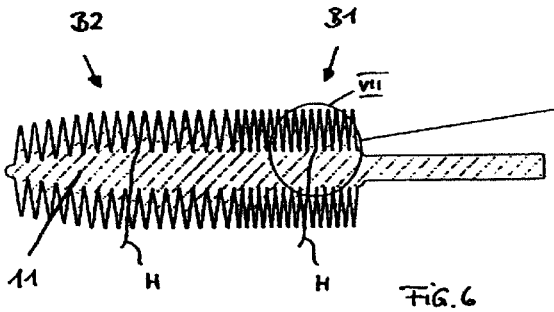
FIG. 6 shows a longitudinal section through a further embodiment of the applicator brush.
Figure 7:
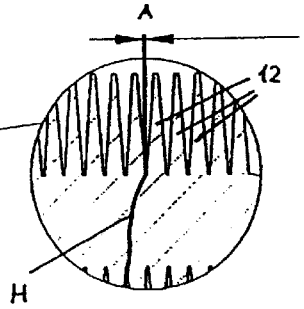
FIG. 7 shows the detail VII of FIG. 6.

FIGS. 6 and 7 show an applicator brush 10 whose support 11 has two regions B1 and B2 axially disposed behind each other, wherein the fingers are disposed at different mutual separations. While the fingers in the front region B2, surrounding the tip of the support 11, have a relatively wide foot section, the fingers in the axially adjacent rear region B1 are smaller, i.e. they have a smaller foot section. This increases the finger density. The radial length of the fingers is the same in both sections.

FIG. 7 shows that the separation A between neighboring fingers in the foot region is chosen such that an individual hair H can penetrate into the space between two fingers 12, down to their feet. The separation is, in particular, in the region between 0.03 and 0.1 mm and in particular approximately 0.05 mm, which corresponds to the average thickness of an eyelash or an eyebrow hair. The fingers in the region B1 and in the region B2 have a corresponding design.

Figure 8:
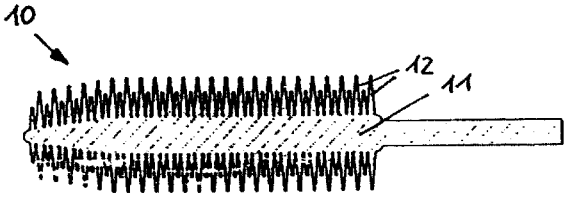
FIG. 8 shows a longitudinal section of a further embodiment of an applicator brush.

FIG. 8 shows an applicator brush 10 with adjacent long and short fingers alternately disposed in the longitudinal direction, wherein the short fingers have a length of approximately half or ⅔ that of the long fingers.

Figure 9:
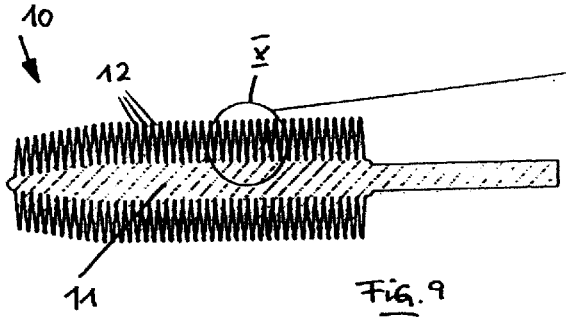
FIG. 9 shows a longitudinal section of a further embodiment of the applicator brush.
Figure 10:
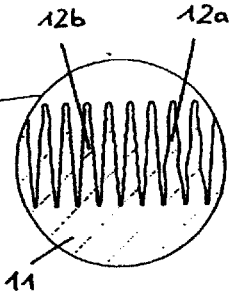
FIG. 10 shows the detail X of FIG. 9.

FIGS. 9 and 10 show an applicator brush 10 whose fingers have a surface structure. The detailed representation (FIG. 10) shows that the fingers can be wavy (12*a*) or have teeth on their surface (12*b*).

Figure 12:
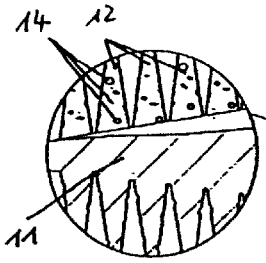
FIG. 12 shows the detail XII of FIG. 11.
Figure 11:
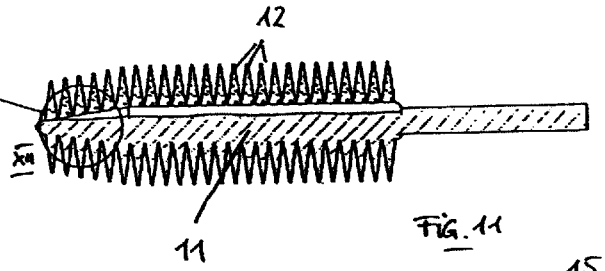
FIG. 11 shows a further embodiment of the applicator brush, partly in sections.

FIGS. 11 and 12 show an applicator brush whose fingers 12 have small depressions 14 on their surfaces for accommodating the medium, e.g. mascara, to be applied. The mascara is released from the depressions during use of the applicator brush 10.

Figure 14:
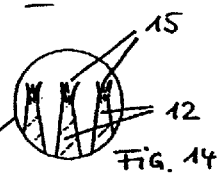
FIG. 14 shows the detail XIV of FIG. 13.
Figure 13:
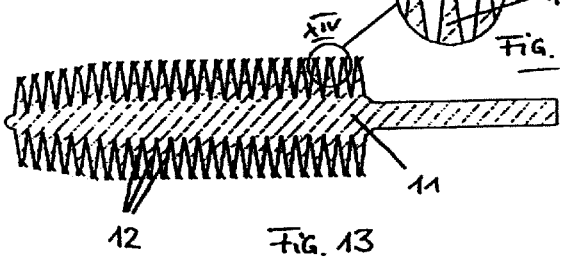
FIG. 13 shows a longitudinal section of an alternative embodiment of the applicator brush.

In a further development in accordance with FIGS. 13 and 14, the outer free ends of the fingers are split several times over a very short radial region such that their tips form bristle-like tentacles 15 to increase the combing effect.

Figure 15:
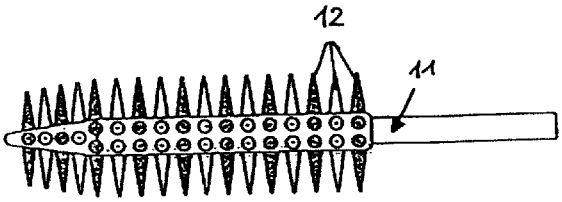
FIG. 15 shows a side view of a further embodiment of the applicator brush.

FIG. 15 shows an applicator brush having fingers 12 of different plastic materials injected onto the support 11 which can be differentiated by the user. In the embodiment shown, the fingers of different material alternate in the axial direction of the support. In some regions, the fingers can be made from the same plastic material.

Figure 16:
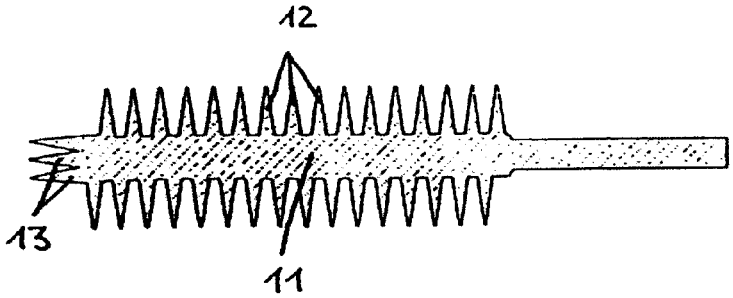
FIG. 16 shows a longitudinal section of a further embodiment of the applicator brush.

In contrast to the above embodiments, wherein the fingers project only radially from the support, FIG. 16 shows an applicator brush 10 with several additional axially extending fingers 13 formed at the front end of the support 11, which constitute a single plastic component together with the support 11 and the fingers 12.

Figure 17:
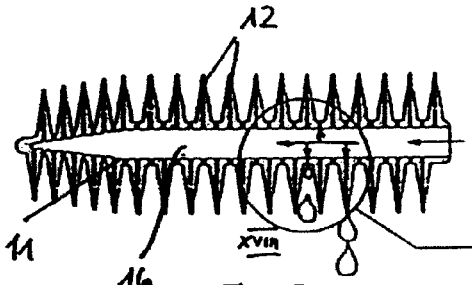
FIG. 17 shows a longitudinal section of an alternative embodiment of the applicator brush.
Figure 18:
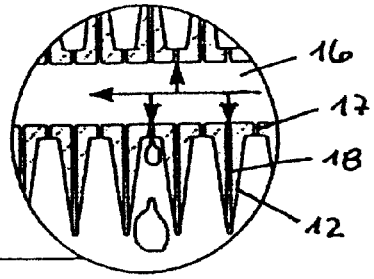
FIG. 18 shows the detail XVIII of FIG. 17.

FIGS. 17 and 18 show a system for supplying mascara to the individual fingers 12. Towards this end, an axial channel 16 is provided in the support 11 which can be supplied with mascara from a supply container (not shown) as indicated by arrows. The fingers have internal outlet channels 18 whose inner ends are connected to the axial channel 16 and which terminate in the finger 12 tips. Further outlet channels 17 are provided which terminate in the foot region between two neighboring fingers. As indicated in the figures, the mascara can pass through the outlet channels 17 and 18 from the axial channel 16 to the outside of the applicator brush.

Figure 19:
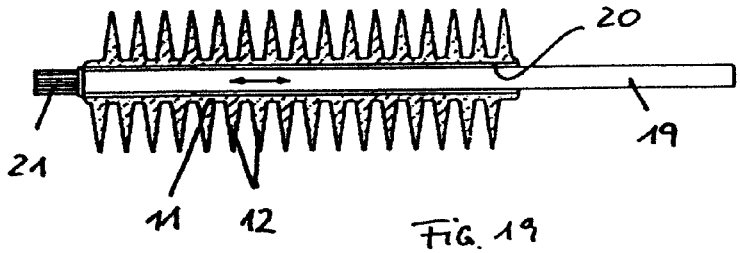
FIG. 19 shows a longitudinal section of a further embodiment of the applicator brush.
Figure 20:
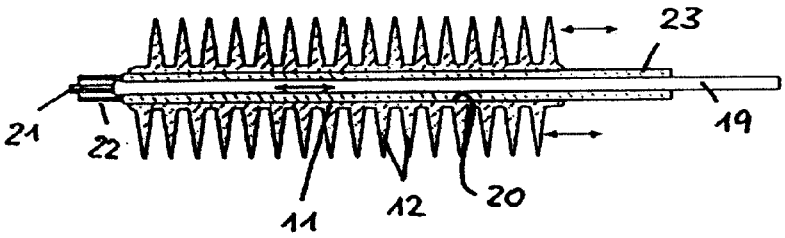
FIG. 20 shows a further development of the applicator brush in accordance with FIG. 19.

FIGS. 19 and 20 each show one applicator brush 10 with an extendable additional applicator 21 and 22 at its tip. The support 11 of the applicator brush 10 in accordance with FIG. 19 has an internal axial channel 20 in which a holding rod 19 is guided in a displaceable fashion and which has an additional applicator 21 at its front end. The additional applicator can be extended by displacement of the holding rod 19 at the front end of the applicator brush 10 (FIG. 19) or can be accommodated inside the support 11 by withdrawing the holding rod 19.

FIG. 20 shows a further development of the applicator brush in accordance with FIG. 19, wherein two coaxial holding rods 19 and 23 are provided each of which bears one additional applicator 21 and 22 at its front end. The two holding rods 19 and 23 can be displaced relative to one another and relative to the support 11 such that both additional applicators 21 and 22 can be extended and withdrawn either individually or together.

FIGS. 21 and 22 show an applicator brush (already described) in the embodiment of FIG. 1, whose rear end 11*a* of the support 11 is connected to a guiding part 24 which is displaceably received in a casing 25. An actuating section 24*a* of the guiding part 24 projects past the outside of the casing 25 such that a user can adjust the guiding part 24 through displacement of the actuating section 24*a* within the casing 25, between an operating position (FIG. 21) in which the applicator brush 10 is disposed outside the casing 25, and a resting position in which the applicator brush 10 is completely withdrawn into the casing 25. FIG. 22 shows an intermediate state during withdrawal of the applicator brush.

The front end of the casing 25 is closed by a diaphragm 26 (indicated by broken lines) which is crosswise slit corresponding to the alignment of the fingers 12 on the support 11 (FIG. 23). The slits 27 are sufficiently narrow that, in the undeformed state, the diaphragm 26 seals the inside of the casing 25 from the surroundings.

Mascara is located within the casing 25 and can be received by the fingers 12. When extending the applicator brush 10, excess mascara is wiped off by the diaphragm flaps defined by the slits 27 such that a sufficient amount of mascara is present in the foot regions between the fingers 12.

Figure 24:
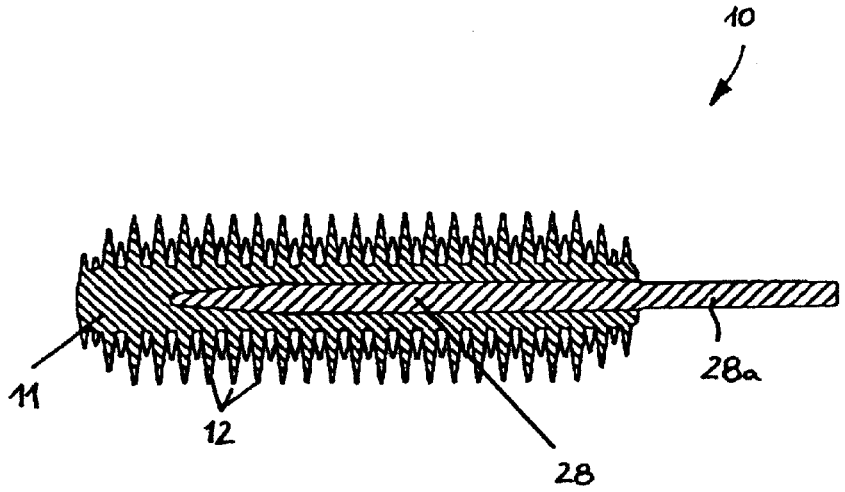
FIG. 24 shows a longitudinal section through a further embodiment of an applicator brush.

FIG. 24 shows an alternative embodiment of an applicator brush 10 which has a rod-shaped reinforcing insert 28 made from a fiber-reinforced plastic material. Part of the length of the reinforcing insert 28 is surrounded with injected elastomeric plastic material of the support 11 and the fingers 12 formed in one piece thereon, wherein one end of the reinforcing insert 28 is disposed in the support 11 and the opposing end projects therefrom such that the projecting part forms a holding or mounting section 28*a* where the applicator brush can be directly grasped by the user or be mounted to a further gripping or holding part. The figure shows that the reinforcing insert 28 extends centrally in the support 11 through approximately 80% of its length, wherein the outer diameter of the support is 3.0 to 3.5 times the diameter of the reinforcing insert 28 such that the reinforcing insert is covered by the elastic plastic material of the support 11 with a thickness which corresponds to approximately 1 to 1.2 times the diameter of the reinforcing insert 28. The front end of the reinforcing insert 28 disposed in the support 11 has a separation from the front end of the support 11 which is sufficient to provide same with the required flexibility.

I claim:

1. A method for manufacturing an applicator brush for liquid means, pasty means, decorative cosmetics and mascara, the method comprising the step of:

injection molding a second plastic material to surround a reinforcing insert, consisting essentially of a first plastic material, within the injection mold, said second plastic material forming a support having an outer structure integral therewith, said outer structure comprising a plurality of fingers projecting from said support in a plurality of different radial directions and disposed at mutual separations, each of said fingers having a cone-shape whose cross-section tapers towards a free end of said finger, wherein said second plastic material is a soft-elastic material or an elastomeric plastic material.

2. The method of claim 1, wherein said reinforcing insert is rod-shaped and extends in a longitudinal direction of said support.

3. The method of claim 1, wherein said reinforcing insert projects past said support with a projecting part of said reinforcing insert forming at least one of a holding and a mounting section.

4. The method of claim 1, wherein said reinforcing insert consists essentially of at least one of a fiber-reinforced plastic material and polypropylene.

5. The method of claim 1, wherein said reinforcing insert extends through more than half a length of said support.

6. The method of claim 1, wherein said fingers are aligned in several rows extending in a longitudinal direction of said support.

7. The method of claim 1, wherein said reinforcing insert is produced in said injection mold.

8. An applicator brush produced by the method of claim 1.

* * * * *